US009180696B2

(12) United States Patent
Togo et al.

(10) Patent No.: US 9,180,696 B2
(45) Date of Patent: Nov. 10, 2015

(54) RECORDING APPARATUS INCLUDING A SUBSTRATE FOR MOUNTING ELECTRONIC COMPONENTS

(71) Applicant: SEIKO EPSON CORPORATION, Tokyo (JP)

(72) Inventors: Katsumi Togo, Shiorjiri (JP); Daisuke Imai, Matsumoto (JP); Kazunori Takabayashi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 13/935,081

(22) Filed: Jul. 3, 2013

(65) Prior Publication Data

US 2014/0009550 A1 Jan. 9, 2014

(30) Foreign Application Priority Data

Jul. 6, 2012 (JP) ..... 2012-152162

(51) Int. Cl.

| | |
|---|---|
| ***B41J 2/14*** | (2006.01) |
| ***B41J 13/00*** | (2006.01) |
| ***B41J 29/13*** | (2006.01) |
| *B41J 2/175* | (2006.01) |
| *B41J 29/02* | (2006.01) |

(52) U.S. Cl.

CPC ..... *B41J 13/0009* (2013.01); *B41J 29/02* (2013.01); *B41J 29/13* (2013.01); *B41J 2/14072* (2013.01); *B41J 2/1752* (2013.01); *B41J 13/00* (2013.01); *B41J 29/023* (2013.01); *B41J 29/026* (2013.01); *B41J 2002/14491* (2013.01)

(58) Field of Classification Search

CPC ..... B41J 2002/14491; B41J 2/14072; B41J 13/00; B41J 2/1752; B41J 29/02; B41J 29/023; B41J 29/026

USPC ..... 347/50, 49, 108

See application file for complete search history.

(56) References Cited

U.S. PATENT DOCUMENTS

| | | | | |
|---|---|---|---|---|
| 8,014,037 | B2 * | 9/2011 | Iwata et al. | 358/400 |
| 2004/0051769 | A1 | 3/2004 | Tsusaka et al. | |
| 2008/0074464 | A1 * | 3/2008 | Sumii et al. | 347/36 |
| 2011/0169385 | A1 * | 7/2011 | Watanabe et al. | 312/223.2 |
| 2011/0236073 | A1 | 9/2011 | Komatsu et al. | |

FOREIGN PATENT DOCUMENTS

| | | |
|---|---|---|
| JP | 06-115217 | 4/1994 |
| JP | 2006-139053 | 6/2006 |
| JP | 2008-160217 | 7/2008 |

OTHER PUBLICATIONS

European Search Report for Application No. 13175626.4 dated Dec. 16, 2014.

* cited by examiner

*Primary Examiner* — Henok Legesse
(74) *Attorney, Agent, or Firm* — Workman Nydegger

(57) ABSTRACT

A main substrate which is arranged in one end section of a main apparatus body in the width direction is horizontally arranged using a free space in one end section of the mechanical component arrangement area in a main apparatus body in the width direction. A plurality of relay substrates are vertically provided in the upper-side position of the main substrate in the mechanical component arrangement area, and the main substrate is connected to the plurality of relay substrates through FFCs connected to respective connectors. A plurality of connectors are provided on the two relay substrates in order to connect to wirings from a printer mechanism section.

15 Claims, 8 Drawing Sheets

RECORDING APPARATUS INCLUDING A SUBSTRATE FOR MOUNTING ELECTRONIC COMPONENTS

BACKGROUND

1. Technical Field

The present invention relates to a recording apparatus which includes a main substrate on which electronic components for controlling a recording mechanical section are mounted.

2. Related Art

For example, JP-A-6-115217 (for example, paragraphs and [0032], FIGS. 1 and 2, and the like) discloses a recording apparatus which includes a mechanism section provided with a recording head and a paper feed mechanism, a main substrate configured to control the mechanism section, and a power source substrate configured to supply power to the mechanism section and the main substrate, and in which the main substrate and the power source substrate are vertically arranged on right and left sides of the mechanism section.

However, in JP-A-6-115217 (for example, paragraphs [0031] and [0032], FIGS. 1 and 2, and the like), the substrates are arranged in positions corresponding to the outsides of the mechanism section in the width direction (in the horizontal direction). Therefore, for example, even if the substrates are vertically arranged, there is a problem in that the width of the recording apparatus becomes long, and thus the recording apparatus grows in size. In addition, even when the substrates are arranged in positions corresponding to the outsides of the mechanism section in the back and forth direction (in the paper transport direction), the recording apparatus becomes long in the back and forth direction, and thus the recording apparatus grows in size after all. In addition, if the sizes of the substrates are reduced, the size of the recording apparatus can be easily designed to be reduced in size. However, it is difficult to secure a space for a wiring operation to connect wirings to connectors on the substrates in order to control the recording head and a motor which are included in the mechanism section.

SUMMARY

An advantage of some aspects of the invention is to provide a recording apparatus, the size and the thickness of which can be reduced and can be thin.

According to an aspect of the invention, there is provided a recording apparatus including: a mechanism section that includes a transport section which transports a medium, and a recording section which performs recording on the medium; and a substrate on which electronic components are mounted in order to control the mechanism section, and the substrate is arranged between a base of a main apparatus body and the mechanism section in a mechanical component arrangement area in which mechanical components included in the mechanism section are arranged in the main apparatus body.

According to the configuration, the substrate is arranged between the base of the main apparatus body and the mechanism section in the mechanical component arrangement area in which the mechanical components included in the mechanism section in the main apparatus body are arranged. Therefore, compared to a configuration in which the substrate is arranged on the outside of the mechanical component arrangement area, the size of the recording apparatus may be reduced.

In the recording apparatus, it is preferable that the substrate be arranged in either section of both end sections which interpose a transport region of the medium in a width direction which crosses the transport direction in the mechanical component arrangement area.

According to the configuration, the substrate is arranged in either section of both end sections which interpose the transport region of the medium in the width direction which crosses the transport direction in the mechanical component arrangement area. Therefore, the size of the recording apparatus in the width direction may be reduced.

In the recording apparatus, it is preferable that the recording apparatus further include a medium reception section in which the medium supplied from a front side of the main apparatus body to the inside of the main apparatus body is set, and the substrate be arranged in a position which is separated from the medium reception section. According to the configuration, the thickness of the recording apparatus in the longitudinal direction may be thin.

In the recording apparatus, it is preferable that the main apparatus body include a power transmission mechanism which configures the transport section, and the substrate be arranged at a bottom of the power transmission mechanism. According to the configuration, the size of the recording apparatus in the width direction may be reduced.

In the recording apparatus, it is preferable that the recording apparatus further include: a liquid ejecting head that ejects liquid toward the medium; and a liquid absorber that absorbs the liquid which is discharged to an outside of an end section of the recording medium from the liquid ejecting head. The liquid absorber may be provided between the medium reception section and the transport section, and the substrate may be arranged at a bottom separated from a region in which the liquid absorber is arranged. According to the configuration, the thickness of the recording apparatus in the longitudinal direction may be thin.

In the recording apparatus, it is preferable that the recording apparatus further include a relay substrate that is connected to the substrate through wirings and includes connectors to be electrically connected to the mechanism section.

According to the configuration, the substrate is arranged between the base of the main apparatus body and the mechanism section. Therefore, it is difficult to secure the wiring operation space on the substrate. However, since connectors are provided on the relay substrates that are connected to the substrate through wirings in order to perform electrical connection with the mechanism section, a wiring operation to electrically connect the substrate to the mechanism section may be performed on the connectors of the relay substrate. Therefore, a problem is generated less in the wiring operation performed between the substrate and the mechanism section, and the size of the recording apparatus may be reduced.

In the recording apparatus, it is preferable that a plurality of the relay substrates be provided. According to the configuration, even though small free spaces are dispersed in the mechanical component arrangement area, a size for a single relay substrate is relatively reduced by providing the plurality of relay substrates, and thus the relay substrates are easily set in the free spaces in the mechanical component arrangement area. Therefore, it is possible to arrange the substrate and the relay substrates in the free spaces in the mechanical component arrangement area. For example, compared to a case in which the relay substrates are not set in the mechanical component arrangement area, the size of the recording apparatus may be effectively reduced.

In the recording apparatus, it is preferable that the plurality of relay substrates be arranged in the either section in the mechanical component arrangement area in which the substrate is arranged.

According to the configuration, since the plurality of relay substrates are arranged in the same one end section as the substrate in the mechanical component arrangement area, wirings to connect between the substrate and the plurality of relay substrates are short, and the wirings are handled in a comparatively simple manner.

In the recording apparatus, it is preferable that the recording section include a carriage provided to be able to move in a direction which crosses the transport direction of the medium, and the plurality of relay substrates be provided on both sides which interpose a movement area of the carriage in the transport direction.

According to the configuration, since the plurality of relay substrates are arranged on both sides which interpose a carriage movement area, which occupies a comparatively long area of the main apparatus body in the width direction, in the transport direction, it is easy to secure a space for arranging the relay substrates in the mechanical component arrangement area. For example, if an attempt to arrange the relay substrates in places corresponding to the carriage movement area is made in the transport direction, there is a problem in that the sizes of the relay substrates are reduced, and the number thereof is uselessly increased, or in that a large amount of change in the layout of functional components is forced to secure a space for arranging the relay substrates. However, since the relay substrates are arranged on both sides which interpose the carriage movement area, the sizes of the relay substrates are less reduced and an appropriate number of relay substrates is obtained without a large amount of change in the layout of the functional components.

Further, in the recording apparatus, it is preferable that the substrate be arranged in a free space on a lower side of the mechanism section while a mounting surface for the electronic components faces upwards, and the relay substrates be vertically arranged such that a mounting surface for the connectors faces the outside of the main apparatus body in the width direction.

According to the configuration, the substrate is arranged in the free space on the lower side of the mechanism section while the mounting surface of the electronic components faces upwards, and thus it is difficult to secure a wiring operation space on the upper side of the substrate. However, since the relay substrates are vertically arranged such that the mounting surface of the connectors faces the lateral outside of the main apparatus body, it is easy to secure a space for disposing the relay substrates. Further, since the connectors face outward, it is easy to perform the wiring operation on the connectors.

In the recording apparatus, it is preferable that the recording apparatus further include: a main body frame that is arranged in the main apparatus body; other substrates that are controlled by the substrate; a second connector that is mounted on the substrate to be connected to a wiring between the substrate and the other substrates; and a lateral plate section that extends from the main body frame to be arranged on an outside of the power transmission mechanism in the width direction in the mechanical component arrangement area. The wiring which includes one end section connected to the second connector may be wired on a surface opposite to the power transmission mechanism of the lateral plate section, and may be configured to include the other end section connected to the other substrates.

According to the configuration, a wiring which connects the substrate to another substrate is wired to a surface opposite to the power transmission mechanism of the lateral plate section. Therefore, for example, even when the wiring is deviated from a proper wiring path because the wiring becomes loose, it is possible to avoid a state in which the deviated wiring comes into contact with the power transmission mechanism.

In the recording apparatus, it is preferable that the recording apparatus further include: a main body frame that is arranged in the main apparatus body; and a lateral plate section that extends from the main body frame to be arranged on an outside of the power transmission mechanism in the width direction in the mechanical component arrangement area. In the lateral plate section, a notch recess is preferably formed in a section corresponding to a path of the wiring connected between the connector of the substrate and the relay substrate.

According to the configuration, it is possible to perform the wiring operation to connect the connectors on the substrates to the relay substrate using the wirings through the notch recess of the lateral plate section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which a recording apparatus is embodied in an ink jet type printer will be described with reference to FIGS. 1 to 13.

Figure 1:
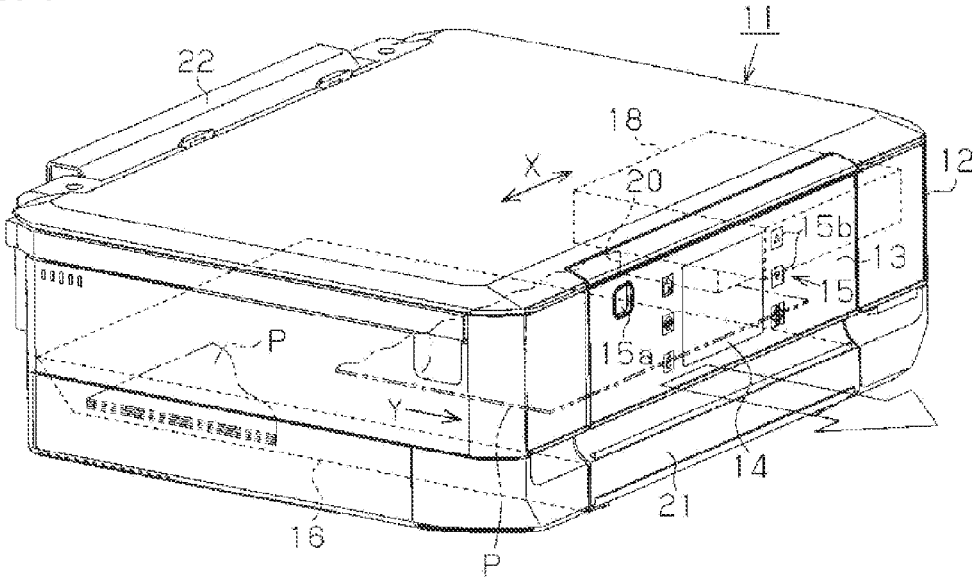
FIG. 1 is a perspective view illustrating a printer according to an embodiment.

As shown in FIG. 1, a printer 11 includes a main apparatus body 12 which has a thin and substantially rectangular parallelepiped shape, and an operating panel 13 which is provided on the front side of the main apparatus body 12 (right side in FIG. 1) and is used for an input operation performed by a user. The operating panel 13 is configured to be capable of rotating forward from the front surface of the main apparatus body 12 with the upper section thereof being used as a rotary shaft. The operating panel 13 includes a display unit 14 which is formed of a liquid crystal panel or the like, and an operating unit 15 which includes a plurality of operating switches. The operating unit 15 includes a power source switch 15*a* to turn on or off the power source of the printer 11, and selection switches 15*b* to select a desired selection item on a menu screen displayed on the display unit 14.

As shown in FIG. 1, a feed cassette 16, which functions as a medium reception section capable of receiving a plurality of pieces of paper P as an example of a medium, is detachably (insertable and extractable) mounted in the lower side position of the operating panel 13 on the front surface of the main apparatus body 12. The plurality of pieces of paper P which are received in the feed cassette 16 are sequentially sent one by one from the top from the feed cassette 16 by a pickup roller 17 (refer to FIG. 3), and the sent paper P is transported along a predetermined transport path in the transport direction Y.

In addition, as shown in FIG. 1, in a housing 12*a* which forms the exterior of the main apparatus body 12, a carriage 18 is guided by a guide rail 19 (refer to FIG. 4) installed to be extended in the horizontal scan direction X which crosses the transport direction Y, and is provided in a state in which the carriage 18 can reciprocate along the horizontal scan direction X. A recording head 20, which includes a plurality of nozzles for ejecting ink drops on the transported paper P, is attached to the bottom of the carriage 18. The paper P which is printed is discharged in the direction, indicated by a void arrow in FIG. 1, from a discharging port which is exposed when a cover 21, provided on the front surface of the feed cassette 16 to be rotatable with the bottom thereof being used as a rotary shaft, is open. Meanwhile, an open/close type cover 22, which closes the feeding port through which the paper P can be manually inserted, is provided in the rear of the main apparatus body 12, and it is possible to open the cover 22, manually insert the paper P through the feeding port, and to print the paper P.

Figure 2:
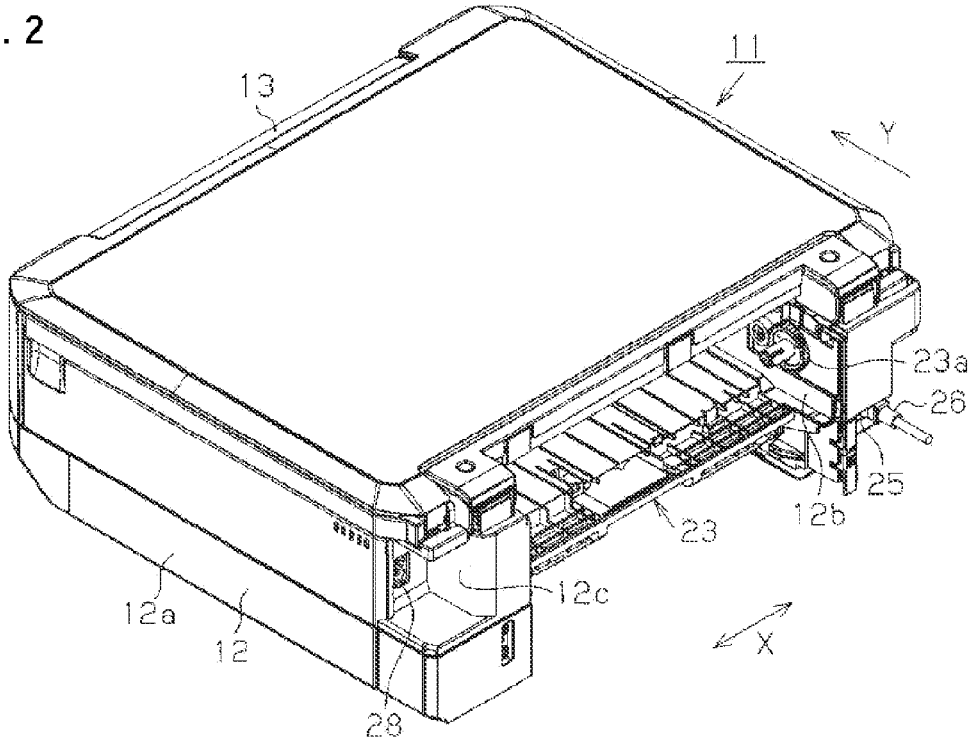
FIG. 2 is a perspective view illustrating the rear side of the printer.

As shown in FIG. 2, a feed mechanism 23 to feed paper from the feed cassette 16 is provided on the back surface of the printer 11 (front surface in FIG. 2). Meanwhile, FIG. 2 illustrates a state in which a feed unit (refer to FIG. 3) is removed which is detachably mounted on the mounting recess 12*b* of the main apparatus body 12, which performs a feed operation using power transmitted through a gear 23*a* in the feed mechanism 23 in a mounted state, and which includes the manual cover 22.

As shown in FIG. 2, in the right end section of both end sections, which interpose the mounting recess 12*b* in the width direction (the same as the horizontal scan direction X) which crosses the transport direction Y, on the back surface of the main apparatus body 12, for example, a communication port 25 (refer to FIG. 7) through which the terminal of a LAN cable (not shown in the drawing) is inserted and connected, and a communication port 27 (refer to FIG. 7) through which the terminal of a USB cable 26 is inserted and connected are provided. In addition, a recess 12*c* which forms a rectangular parallelepiped reception space is formed in a left corner section on the back surface of the main apparatus body 12 in FIG. 2, and a power source insertion port 28 (for example, a power source inlet insertion port) to connect to a power source plug (not shown in the drawing) is provided in the back surface facing the front of the recess 12*c*.

Hereinafter, the components of the print mechanism section of the printer 11 will be described with reference to FIG. 3.

Figure 3:
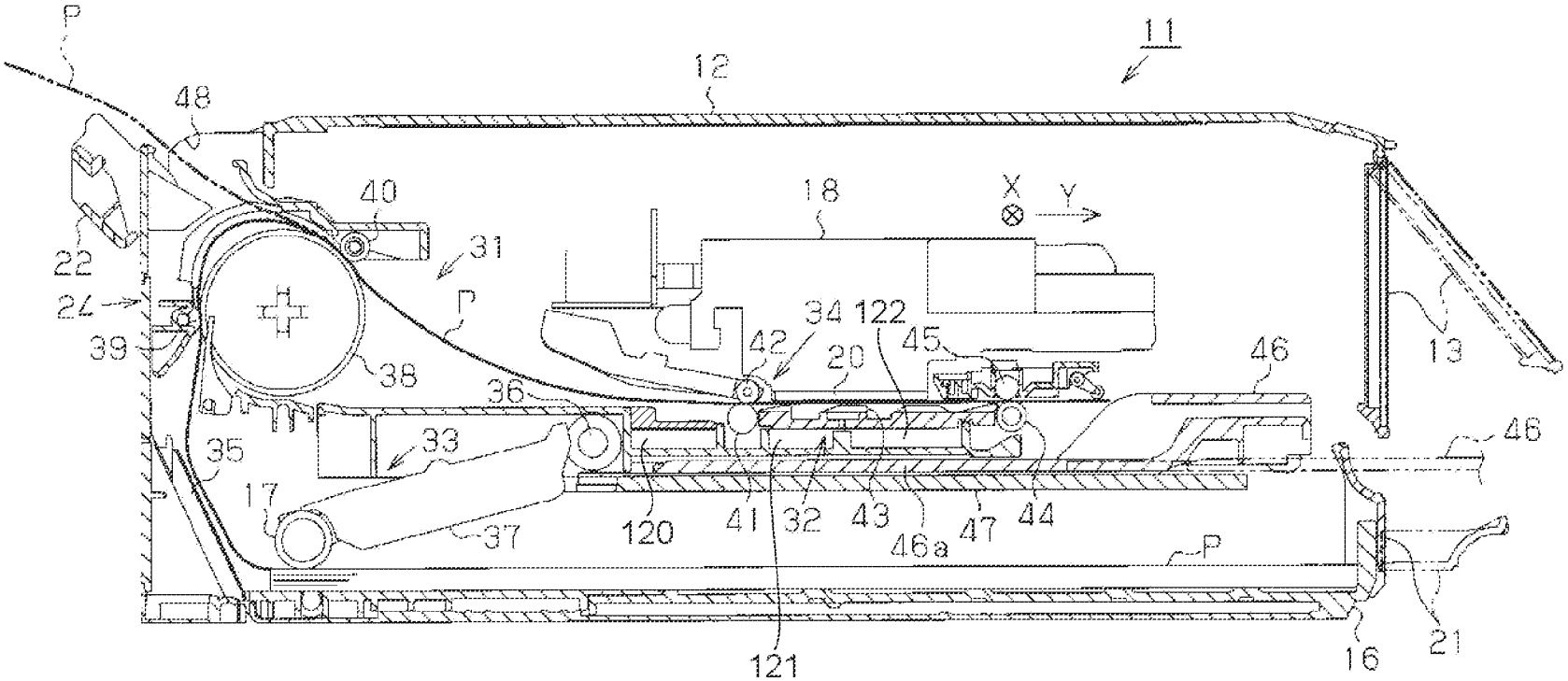
FIG. 3 is a sectional side view schematically illustrating the printer.

As shown in FIG. 3, a transport section 31 which feeds, transports, and discharges the paper P, and a recording section 32 are provided in the main apparatus body 12. The transport section 31 includes a feed section 33 and a medium transport section 34. The feed section 33 includes the feed cassette 16, the pickup roller 17 provided on the upper side of the feed cassette 16, and a separation section 35 provided in a position which faces the leading edge of the paper P received in the feed cassette 16.

The pickup roller 17 is provided in the leading edge of an oscillation member 37 which oscillates about the center of an oscillation shaft 36, and rotationally driven by power which is transmitted from a transport motor (not shown in the drawing). The pickup roller 17 comes into contact with top of the pieces of paper P which are received in the feed cassette 16 and then rotates, thereby sending the top paper P from the feed cassette 16 to a feed path. At this time, the top paper P which is sent from the feed cassette 16 due to the rotation of the pickup roller 17 is separated from subsequent paper P by the separation section 35 on the way of being sent.

In addition, as shown in FIG. 3, the feed section 33 includes a feed driving roller 38 which is driven by the transport motor, and a separation roller 39 and a feed driven roller 40 which comes into contact with the feed driving roller 38 on the downstream side of the feed path of the separation section 35. When the paper P is fed along the periphery of the feed driving roller 38, the paper P is separated again by the separation roller 39, thereafter, is pinched between the feed driving roller 38 and the feed driven roller 40, and is transported to the medium transport section 34. The medium transport section 34 also includes a transport driving roller 41 which is driven by the same transport motor, and a transport driven roller 42 which is rotationally driven in pressure contact with the transport driving roller 41. The paper P is sent to a further downstream side by the medium transport section 34.

As shown in FIG. 3, the recording section 32 includes the carriage 18, the recording head 20, and a support 43 which faces the recording head 20. The recording head 20 which is provided at the bottom of the carriage 18 prints an image on the paper P by ejecting ink drops on the paper P in the process where the carriage 18 is guided by the guide rail 19 (refer to FIG. 4) using the power of a carriage motor (not shown in the drawing) and reciprocates in the horizontal scan direction X (direction perpendicular to paper in FIG. 3). At this time, the support 43 supports the paper P, and determines the distance (gap) between the paper P and the recording head 20 as a value which is appropriate for printing.

Further, the first roller 44 and the second roller 45 are provided on the downstream side of the support 43 and the printed paper P is sent in a state in which the paper P is pinched between a first roller 44 which is driven by the transport motor and a second roller 45 which is rotationally driven in contact with the first roller 44.

The printed paper P which is sent by the first and second rollers 44 and 45 is discharged on a stacker 46 which protrudes to the front of the main apparatus body 12 and which is shown using a chain double-dashed line in FIG. 3. The stacker 46 in the example in FIG. 3 is electrically driven in such a way that a base portion 46*a* is inserted to a guide section 47 which is arranged on the lower side of the support 43 and is capable of reciprocating along the Y direction. At least at the time of printing, the stacker 46 slides to a reception position which protrudes to the outside of the main apparatus body 12 while the operating panel 13 which shares a power source with the stacker 46 rotates to an open position which is shown using a chain double-dashed line in FIG. 3.

In addition, in the embodiment, when the paper P (shown in a chain double-dashed line in FIG. 3) is inserted through a feeding port 48 exposed when the manual cover 22 is open, it is possible to print the paper P which is manually inserted. Meanwhile, the transport section 31 according to the embodiment includes power transmission mechanisms 58 and 59 (refer to FIG. 4) which are interposed between the transport motor and the respective sections 33 and 34 in addition to the feed section 33, the medium transport section 34, and the transport motor.

Liquid absorbers 120, 121, and 122 are provided between the medium transport section 34 and the feed cassette 16 in FIG. 3. The liquid absorber 120 is provided on the upper stream side of the transport driving roller 41 in the transport direction Y. The liquid absorbers 121 and 122 are provided on the downstream side of the transport driving roller 41 in the transport direction Y.

When an image is formed by ejecting ink from the recording head 20 on the end section of the paper P which is supported and transported by the support 43, ink is ejected from the recording head 20 on the outside of the end section of the paper P. The ink which is ejected on the outside of the end section of the paper P is absorbed by the liquid absorbers 121 and 122 which are provided on the lower side of the support 43.

The liquid absorber 120 is connected to the liquid absorbers 121 and 122 by a liquid absorber which is not shown in the drawing, and ink which is absorbed by the liquid absorbers 121 and 122 is absorbed by the liquid absorber 120.

Figure 4:
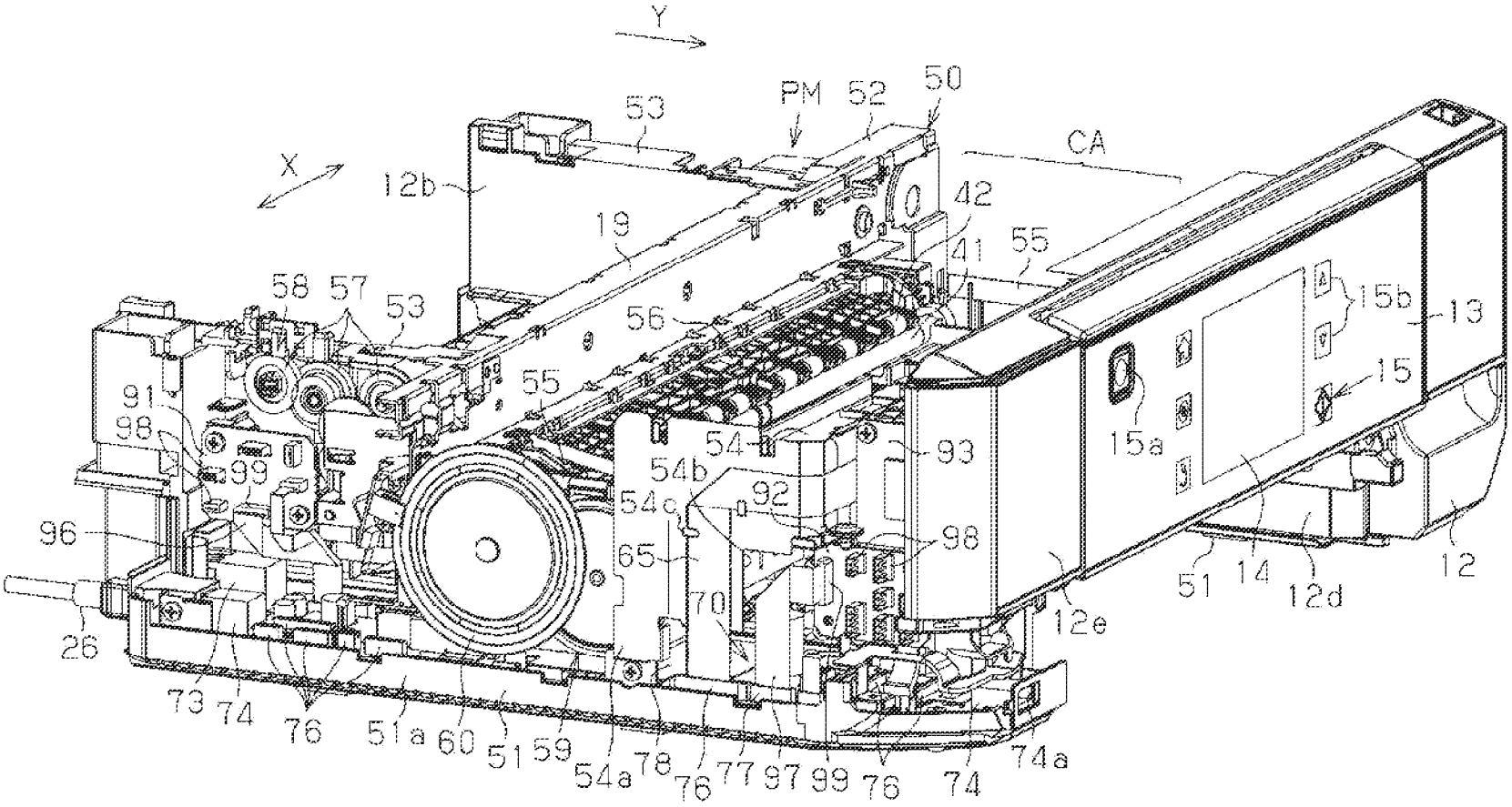
FIG. 4 is a perspective view illustrating a state in which a printer housing or the like is removed.
Figure 5:
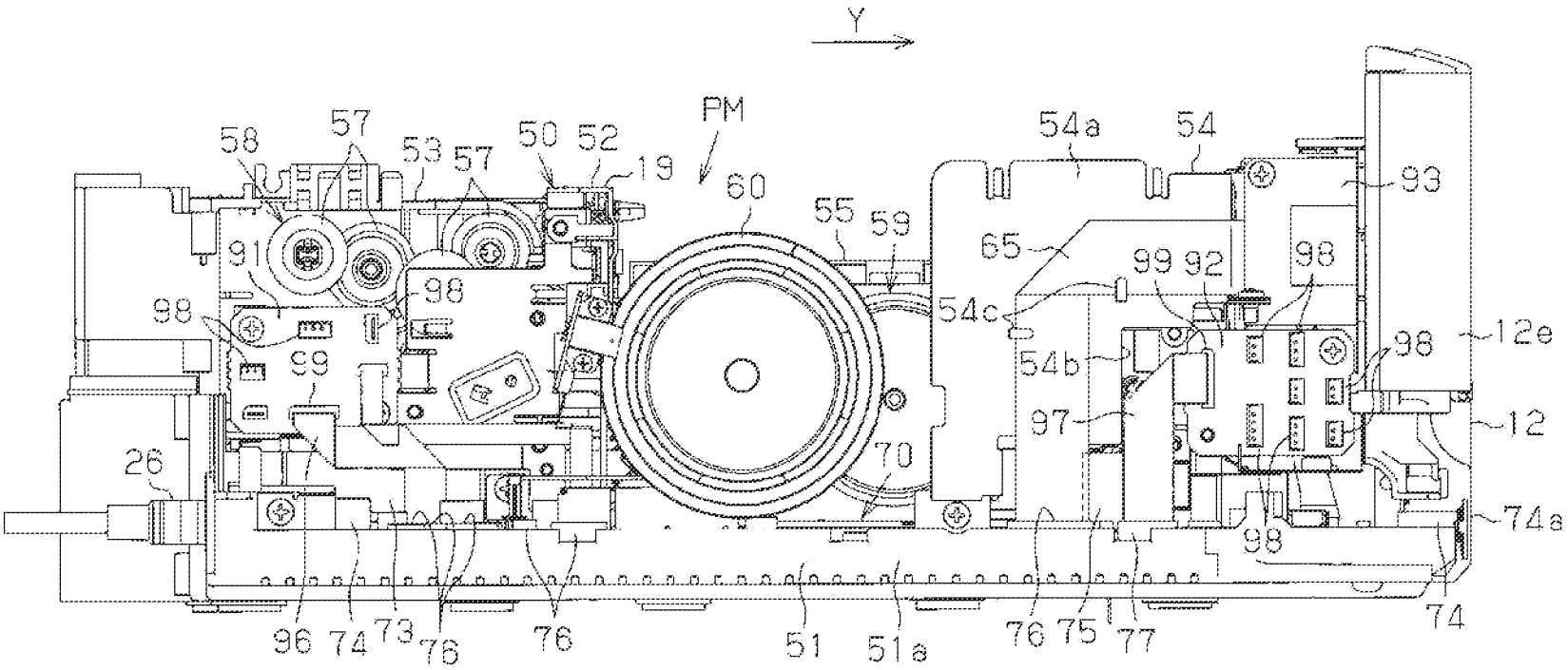
FIG. 5 is a side view illustrating the state in which the printer housing or the like is removed.

FIGS. 4 and 5 show a state in which the housing 12*a* (however, a front housing 12*e* is excluded), the carriage 18, and the like are removed from the main apparatus body 12. As shown in FIGS. 4 and 5, a main body frame 50 includes a pair of right and left base frames 51 which form bases on both sides which interpose the arrangement region of the feed cassette 16 (refer to FIGS. 1 and 3) in the width direction X, and a central frame 52 which is installed with a predetermined height so as to be extended along the horizontal scan direction X in a state of being supported by the pair of right and left base frames 51. In addition, the main body frame 50 includes a pair of right and left rear frames 53 which extend backward from the vicinities of the both end sections of the central frame 52 in the width direction and which form the mounting recess 12*b*. Further, the main body frame 50 includes a foreside frame 54 which is installed with a predetermined height so as to be extended along the horizontal scan direction X on the back surface side of the front housing 12*e* to which the operating panel 13 is attached. In addition, the main body frame 50 includes a pair of right and left lateral frames 55, which are extended along the transport direction Y (forward and backward direction) while connecting the foreside frame 54 and the rear frame 53, on both side positions which interpose the arrangement region of the feed cassette 16 (refer to FIG. 1). Meanwhile, the foreside frame 54 includes an approximately square plate-shaped lateral plate section 54*a* which extends backward approximately parallel with the lateral frame 55 while the lateral plate section 54*a* is separated with a predetermined clearance from the lateral frame 55 on the outside thereof in the width direction.

As shown in FIG. 4, a guide rail 19 which guides the carriage 18 (refer to FIG. 3) is integrally formed with the foreside of the central frame 52. A guide plate 56 which guides paper through a predetermined transport path is arranged on the lower side of the central frame 52, and the transport driving roller 41 and the transport driven roller 42 are supported to be able to rotate. Further, the support 43 and the first and second rollers 44 and 45 which are shown in FIG. 3 are disposed on the downstream side in the transport direction Y. A region which is interposed between the central frame 52 and the foreside frame 54 in the transport direction Y is a carriage movement area CA in which the carriage 18 moves.

In addition, the components of the feed section 33, such as the oscillation member 37 and the pickup roller 17 shown in FIG. 3, are arranged at the rear of the lower side of the guide plate 56 which is placed on the lower side of the central frame 52 in FIG. 4. Further, the stacker 46, which has a width corresponding to the conceivable maximum width of paper, is received in a region which ranges from the vicinity of the arrangement position of the oscillation member 37 to the vicinity of the back surface of the front housing 12*e* on the lower side of the support 43.

In addition, as shown in FIGS. 4 and 5, the power transmission mechanism 58, which includes a gear array 57 which configures the transport section 31, is disposed on the outside of the left-side (front side in FIG. 4) rear frame 53. In addition, a power transmission mechanism 59 to transmit the power of the transport motor to each of the rollers 41 and 44, a rotary encoder 60 to measure the amount of the transport of paper, and the like are disposed on the left-side (front side in FIG. 4) lateral frame 55.

In addition, the transport motor and a partial power transmission mechanism of a transport system (either is not shown in the drawing) are disposed on the outside of the right-side (back side in FIG. 4) rear frame 53 in FIG. 4. In addition, a carriage motor, which is not shown in the drawing, is disposed on the back surface side of the right end of the central frame 52. Further, on the front side of the central frame 52, a pair of pulleys which are provided in both end sections of the horizontal scan direction X, a timing belt which is wound around the pair of pulleys to drive the carriage, and a linear encoder which is used to detect the position of the carriage 18 fixed to the timing belt in the horizontal scan direction X (either is not shown in the drawing) are disposed.

In addition, a reception recess 12*d* for the feed cassette is formed in the lower side position of the operating panel 13 in the main body frame 50, and a region which corresponds to the reception recess 12*d* in a planar view of the main apparatus body 12 is a transport region in which paper fed from the feed cassette 16 or the like is transported by each of the rollers 38, 41, 42, 44 and 45. Further, in addition to the transport system rollers 38, 41, 42, 44 and 45 of a printer mechanism section PM, various mechanical components are arranged on both sides which interpose the transport region of the main apparatus body 12 in the width direction X. Further, the housing 12*a* is inserted to cover the outside of the extension section 51*a* which slightly extends to the upper side along the outside periphery of the base frame 51, and is fixed to the base frame 51 by the fastening of a locking or a screw. As described above, a plurality of mechanical components which configure the printer mechanism section PM used for the printing are assembled in the housing 12*a* of the printer 11 at a comparatively high density.

Figure 6:
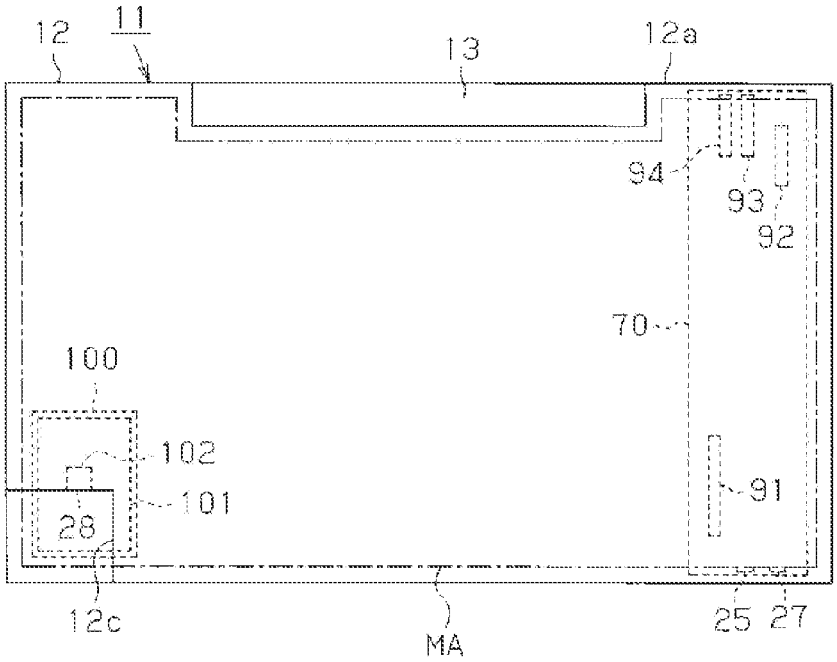
FIG. 6 is a plane view schematically illustrating the layout of a main substrate, a power source unit, or the like of the printer.
Figure 7:
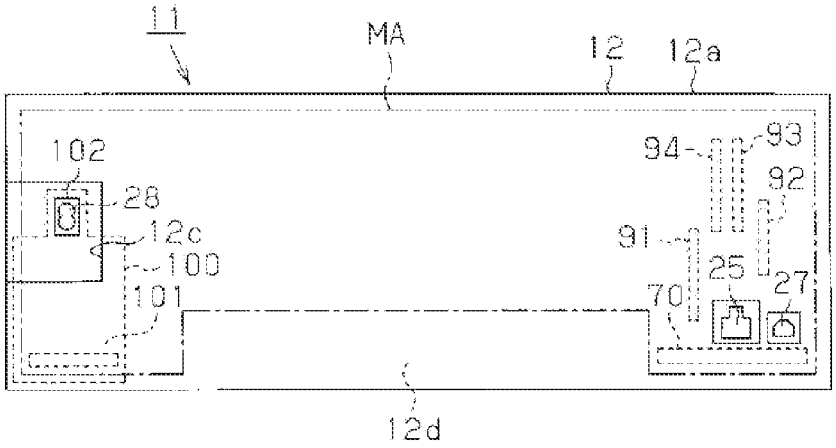
FIG. 7 is a rear view schematically illustrating the same layout of the printer as in FIG. 6.

As shown in FIGS. 6 and 7, a mechanical component arrangement area MA, in which the mechanical components which configure the printer mechanism section PM provided in the main apparatus body 12 are arranged, occupies a majority of region in the housing 12*a*. In the embodiment, a main substrate 70 which functions as a substrate is arranged in the end sections of the communication ports 25 and 27 of the printer 11 in the width direction X using free spaces in the mechanical component arrangement area MA such that the longitudinal direction of the main substrate 70 is identical to the back and forth direction (vertical direction in FIG. 6) of the printer 11. That is, the main substrate 70 is arranged such that the longitudinal direction thereof is parallel to the transport direction in either section of both end sections which interpose the transport region in the mechanical component arrangement area MA in the width direction X. Further, the main substrate 70 in the example is horizontally arranged such that the substrate surface is parallel to the bottom surface of the printer 11. The main substrate 70 manages various types of data processing and various types of control which are necessary to drive the printer mechanism section PM including communication control performed through the communication ports 25 and 27.

In addition, as shown in FIGS. 6 and 7, a power source unit 100 is arranged in the mechanical component arrangement area MA using a free space on the rear end side of the end section of the power source insertion port 28 in the width direction X of the printer 11. That is, the power source unit 100 is arranged on the rear end side of the other end section opposite to one end section in which the main substrate 70 is arranged in the width direction X of the mechanical component arrangement area MA. The power source unit 100 includes a power source substrate 101 and a power source inlet 102 which includes the above-described power source insertion port 28 arranged on the back surface facing the front of the recess 12*c* of the main apparatus body 12.

Here, since the main substrate 70 is arranged in the free space on the base side of one end section of the mechanical component arrangement area MA in the width direction, it is inevitable that the main substrate 70 is horizontally arranged such that the substrate surface is parallel to the bottom surface of the printer 11 as shown in FIGS. 6 and 7. Further, as shown in FIG. 4, when the main substrate 70 is arranged on the lower side of the printer mechanism section PM such that its component mounting surface faces upwards, at least some areas, in which a wiring operation space is difficult to be secured, are generated because the mechanical components on the upper side of the component mounting surface of the main substrate 70.

Here, in the embodiment, a plurality of (in this example, two pieces of) relay substrates 91 and 92 are vertically arranged in a position which is on the upper side of the main substrate 70 in one end section of the mechanical component arrangement area MA in which the main substrate 70 is arranged in the width direction X. Further, a configuration is made in which the main substrate 70 is connected to the plurality of relay substrates 91 and 92 using wirings, and a wiring operation is performed to connect wirings from some places of the printer mechanism section PM to the respective relay substrates 91 and 92. Further, although connectors 76 are provided in areas, in which a wiring operation space can be secured, of the component mounting surface of the main substrate 70 as shown in FIG. 4, the connectors are not provided in some areas of the main substrate 70, in which the wiring operation space is difficult to be secured. Instead, some connectors 98 are arranged on the side of the relay substrates 91 and 92 as shown in FIG. 4. In the embodiment, for example, the size and the number of relay substrates (in this example, two pieces) are determined based on the size and the number of free spaces which may be secured in the mechanical component arrangement area MA. In addition, the plurality of relay substrates 91 and 92 are vertically arranged such that the respective component mounting surfaces thereof are perpendicular to the bottom surface of the printer 11, and arranged in a pose in which the respective component mounting surfaces thereof face the outside (front side in FIGS. 4 and 5) of the main apparatus body 12 in the width direction. Meanwhile, in the specification, there is a case in which two relay substrates are called a first relay substrate 91 and a second relay substrate 92.

In addition, as shown in FIGS. 6 and 7, a substrate 93 for wireless communication (for example, a Wireless Fidelity (Wi-Fi, registered trademark) substrate) and a substrate 94 provided with a memory card connector are arranged in a position on the upper front side of the main substrate 70. The substrates 93 and 94 are vertically arranged so as to be parallel to the relay substrates 91 and 92. Meanwhile, a card slot (not shown in the drawing) into which the memory card can be inserted is provided on the memory card connector of the substrate 94 on the foreside of the printer 11.

As shown in FIG. 4, the plurality of relay substrates 91 and 92 are arranged on the back side and the front side while interposing the carriage movement area CA in the transport direction Y (back and forth direction). The carriage movement area CA is an area which occupies a considerably long part of the main apparatus body 12 in the width direction X, and in which the considerably long functional components, such as the respective rollers 41 and 42, of the transport system are disposed in the width direction X. Therefore, both sides in the width direction which interpose the carriage movement area CA include a comparatively small free space. Besides, the large mechanical components (the power transmission mechanism 59, the rotary encoder 60, and the like) of the transport system are arranged in the free space. Therefore, if at least one of the relay substrates 91 and 92 is arranged in the place, there are problems in that the layouts of other functional components are forced to be changed and the width of the main apparatus body 12 is slightly broadened.

In contrast, the mounting recess 12*b* is present in the center of the width direction on the rear side of the carriage movement area CA, that is, on the rear side of the central frame 52. The power transmission mechanism 58 or the like of a feed system, which is not a very large functional component, is disposed in the area on the outside of one (front side in FIG. 4) rear frame 53 in the width direction, and then it is comparatively easy to secure a space for the vertical arrangement of the substrates. Therefore, the first relay substrate 91 is vertically arranged on the rear side of the carriage movement area CA using the space such that the mounting surface thereof faces the outside in the width direction.

In addition, a driving system, which rotates the operating panel 13, is disposed in the vicinities of both end sections of the operating panel 13 in the width direction in an area on the front side of the carriage movement area CA shown in FIG. 4, that is, in an area between the foreside frame 54 and the front housing 12*e*. A space in which few mechanical components cannot be disposed is present on both sides which interpose the driving system of the operating panel 13 in the width direction. Further, two substrates 93 and 94 (only the substrate 93 is shown in FIG. 4) are arranged in a state in which the substrates are screwed by a support section (not shown in the drawing) which extends to the front side from the foreside frame 54 with a predetermined height on the upper side of the front-side (side on which the main substrate is arranged) space in FIG. 4. Further, the second relay substrate 92 is vertically arranged on the front side of the carriage movement area CA, that is, a mounting surface faces the outside of the width direction, on the lower side of two substrates 93 and 94 using the free space.

Subsequently, the configuration of the main substrate will be described with reference to FIGS. 8 to 10.

Figure 8:
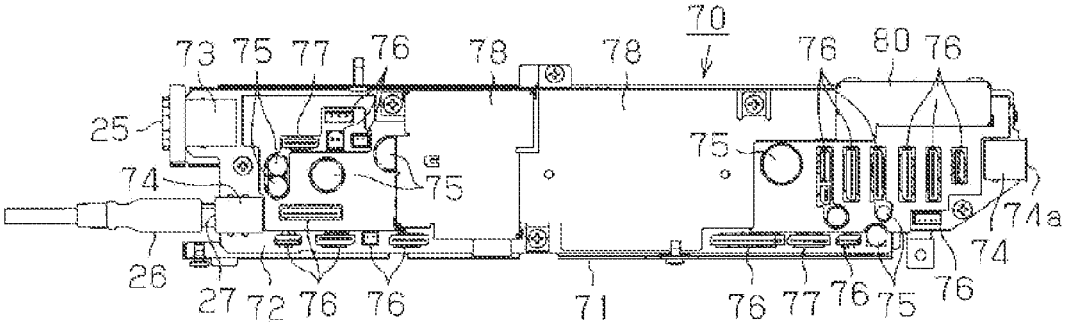
FIG. 8 is a plane view illustrating the main substrate.
Figure 9:
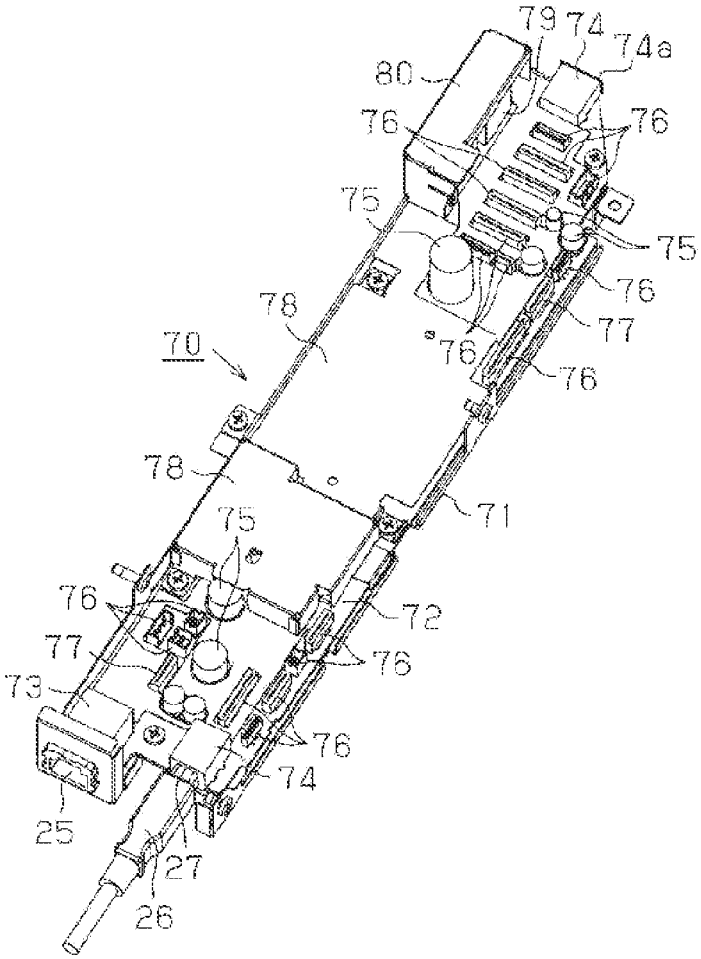
FIG. 9 is a perspective view illustrating the main substrate.

As shown in FIGS. 8 and 9, the main substrate 70 includes a base plate 71 which is formed by performing bending process on a metal plate and has a U-shaped cross section, and a substrate 72 which is fixed on the base plate 71. The substrate 72 is mounted with two communication connectors 73 and 74, many electronic components 75, a plurality of connectors 76 which are connected to some places of the printer mechanism section PM, and a plurality of (in this example, two) connectors 77 which are connected to the relay substrates 91 and 92. The communication connectors 73 are LAN modular jack connectors to which the connector of a LAN cable for LAN communication with a host device is inserted and attached. In addition, the communication connectors 74 are USB connectors (sockets) for a USB cable.

The electronic components 75 include a LAN communication interface circuit, a USB communication interface circuit, a CPU which configures a computer which manages various types of control of the printer 11, an ASIC, a RAM, a nonvolatile memory, a recording head driving circuit, the motor driving circuit of the transport system, the motor driving circuit of the recording system (carriage), and the like. The USB communication connectors 74 are also provided on the substrate 72 at a position, in the width direction, adjacent to the cover 21 in the width direction on the front surface (surface on the side of the operating panel 13) of the printer 11.

In addition, as shown in FIGS. 8 and 9, the central area of the electronic components mounting area on the substrate 72 in the longitudinal direction is covered with a shield or a metal shield cover 78 which has a function of heat radiation. Further, the plurality of connectors 76 are mounted on a rear side area and a front area, which are not covered with the shield cover 78, in the substrate 72. The plurality of connectors 76 are connected with wirings which extend from various actuators, such as the recording head 20, the transport motor, the carriage motor, and wirings which extend from various driving system circuits and various power source system circuits.

As shown in FIGS. 8 and 9, the connector 77, which is connected to a wiring for electrically connecting the main substrate 70 to the first relay substrate 91 is mounted in the rear-side position of the substrate 72 (left-side position in FIG. 8). In addition, the connector 77, which is connected to a wiring for electrically connecting the main substrate 70 to the second relay substrate 92 is mounted in the front-side position (right-side position in FIG. 8) of the substrate 72.

One end section of a flexible flat cable (hereinafter, referred to as "FFC 96") shown in FIG. 5 is connected to the connector 77 on the rear side of the main substrate 70 (refer to FIGS. 8 and 9), and the other end section of the FFC 96 is connected to a connector 99 which is mounted on the first relay substrate 91 shown in FIG. 5. In addition, one end section of a flexible flat cable (hereinafter, referred to as "FFC 97") shown in FIG. 5 is connected to the connector 77 on the front side of the main substrate 70, and the other end section of the FFC 97 is connected to the connector 99 which is mounted on the second relay substrate 92 shown in FIG. 5. In addition, a plurality of connectors 98 which are connected to wirings from some places of the printer mechanism section PM are mounted on the first relay substrate 91, and a plurality of connectors 98 which are connected to wirings from the other places of the printer mechanism section PM are mounted on the second relay substrate 92.

Here, as shown in FIGS. 4 and 5, when the main substrate 70 is arranged on the base frame 51, the connector 77 on the front side of the main substrate 70 is positioned to correspond to the extension region of the lateral plate section 54*a* in the transport direction Y. Therefore, as shown in FIGS. 4 and 5, a notch recess 54*b* is formed in a section of the lateral plate section 54*a* corresponding to the wiring area of the FFC 97 which is connected between the front-side connector 77 and the connector 99 on the second relay substrate 92.

An operator can perform a wiring operation of the FFC 97 through the notch recess 54*b*.

Further, in the mounting surface of the substrate 72 shown in FIGS. 8 and 9, the plurality of connectors 76 are mounted in some areas in which the wiring operation space can be secured and are not much covered with the printer mechanism section PM when the main substrate 70 is arranged in the mechanical component arrangement area MA. The plurality of connectors 76 are connected to wirings which are not connected to the connectors 98 of the relay substrates 91 and 92 of the wirings from some places of the printer mechanism section PM.

In addition, as shown in FIGS. 4 and 5, the flexible flat cable (hereinafter, referred to as "FFC 65") which has one end section connected to one connector 76 on the front side of the main substrate 70 is wired in a predetermined wiring path along the surface of the lateral plate section 54*a* in a state in which the edge thereof is supported in a plurality of places by a plurality of snapping sections 54*c* which are protrusively formed on the outer surface of the lateral plate section 54*a*. Further, the other end section of the FFC 65 is connected to the wireless communication substrate 93 shown in FIGS. 4 and 5. That is, a gear train which configures the power transmission mechanism 59 assembled to the outer surface side of the lateral frame 55 is arranged the inside of the lateral plate section 54*a* in the width direction, and the FFC 65 is wired on the outer surface side of the lateral plate section 54*a* in the width direction. As described above, the FFC 65 is arranged on the side opposite to the power transmission mechanism 59 with the lateral plate section 54*a* interposed therebetween. Therefore, even if, for example, the wiring of the FFC 65 is loose, it is possible to avoid a disadvantage that the loose FFC 65 comes into contact with the components (for example, gear) of the power transmission mechanism 59.

Figure 10:
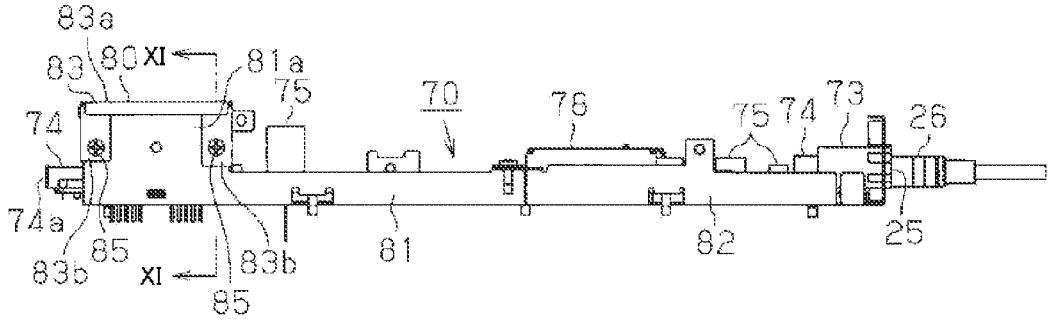
FIG. 10 is a side view illustrating the main substrate.

As shown in FIGS. 8 to 10, a power system electronic component 79 is mounted on the front side of the main substrate 70 (left side in FIG. 10) in a position adjacent to the line of the communication port 27 and the connectors 76 while being covered with the heat-radiation cover 80.

As shown in FIG. 10, the metallic base plate 71, which covers some parts of the bottom surface and side surfaces of the substrate 72, is disposed on the main substrate 70. The base plate 71 includes a first base plate 81 which is formed of aluminum-based metal having a high thermal conductivity in the approximately front half on the side of the power system electronic component 79, and a second base plate 82 which is formed of iron-based metal in the approximately rear half. In the embodiment, as an example, the first base plate 81 is formed of aluminum, and the second base plate 82 is formed of steel and metal plating (for example, nickel plating) is performed on the surface thereof.

Figure 11:
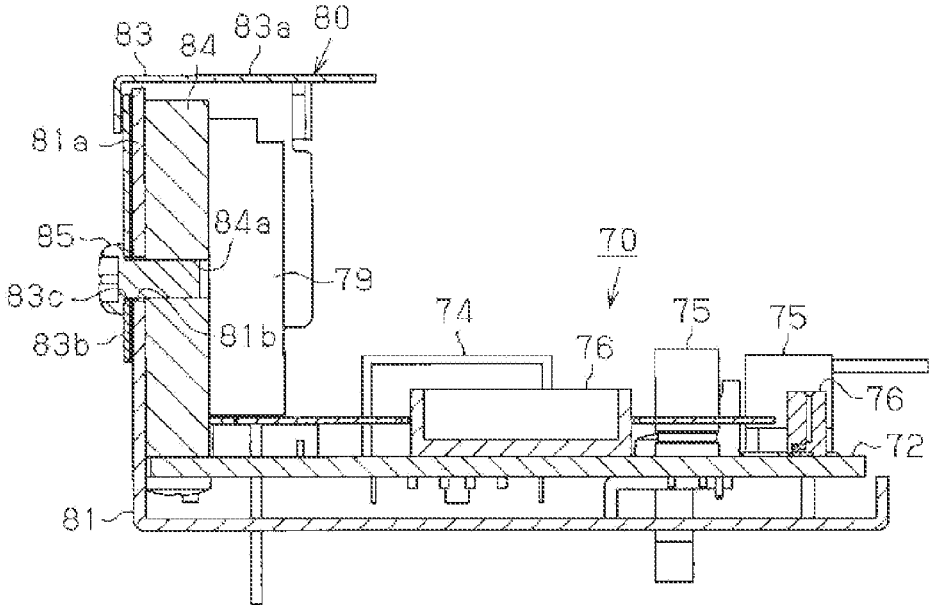
FIG. 11 is a cross-sectional view illustrating the main substrate taken along the line XI-XI in FIG. 10.

As shown in FIGS. 10 and 11, the first base plate 81 covers the bottom side of the substrate 72, and includes a square plate-shaped extension section 81*a* which extends to the upper side in a section corresponding to a mounting place of the power system electronic component 79 (for example, a power transistor). As shown in FIG. 9, the extension section 81*a* includes both end sections in the longitudinal direction of the substrate, which are approximately orthogonally bent to the mounting area side, and which form the front and rear side sections of the heat-radiation cover 80. The heat-radiation cover 80 includes the extension section 81*a* and a top board member 83 as shown in FIGS. 10 and 11. The top board member 83 includes a top board 83*a* which covers the upper-side opening of the extension section 81*a*, and a pair of extension sections 83*b* which extend to the lower side from the both end sections of the top board 83*a* in the back and forth directions in order to be parallel to the extension section 81*a* in FIG. 11. An insertion hole 83*c* (shown in FIG. 11) to which a screw 85 can be inserted is formed in each of the pair of extension sections 83*b*.

As shown in FIG. 11, the power system electronic component 79 includes a metallic heat sink section 84 (heat-radiation plate) which is fixed to the left-side surface section in the drawing. The heat sink section 84 is provided with two (however, only one is shown in FIG. 11) screw holes 84*a* in respective positions corresponding to two insertion holes 81*b* of the extension section 81*a*. When the screw 85, which is inserted to the insertion holes 83*c* and 81*b*, is screwed into the screw hole 84*a*, the heat sink section 84 of the power system electronic component 79 is connected to the extension section 81*a* and the top board member 83 in a state in which thermal conduction can be made. That is, the power system electronic component 79 is fixed to the aluminum first base plate 81 through the heat sink section 84 such that heat can be transferred.

Subsequently, the configuration of the power source unit 100 and the assembly structure thereof will be described.

Figure 12:
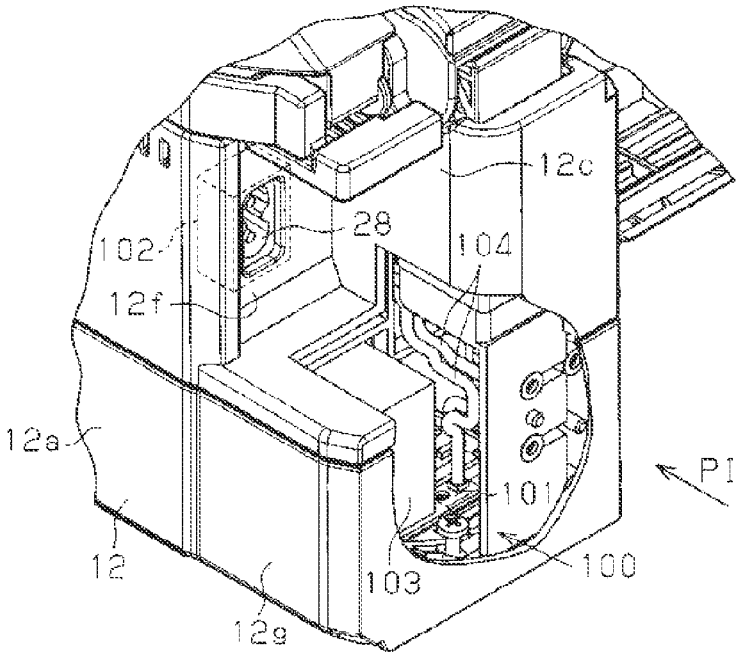
FIG. 12 is a partially fractured perspective view illustrating the assembly structure of a power source unit.

As shown in FIG. 12, the power source unit 100 is assembled to a left end section on the rear surface side of the main apparatus body 12 as described above. The power source insertion port 28 is exposed, to which a power source plug which is not shown in the drawing is inserted and attached, in the back surface 12*f* of the recess 12*c*, which is formed in a left corner on the rear surface side section of the housing 12*a* in FIG. 12. Even when the back surface of the printer 11 is arranged in contiguity with a wall, the recess 12*c* is provided such that the power source plug is received in the recess 12*c* and the printer 11 can be arranged without separating the back surface of the printer 11 from the wall of a room in order to secure a space for arranging the power source plug.

A power source component 103 which is connected to the power source inlet 102 is mounted on the rear side of the power source substrate 101. It is preferable that the power source insertion port 28 is arranged in the vicinity of the power source component 103 because wirings 104 can be short. In the related art, the power source insertion port 28 is arranged in the rear end section of the power source substrate at a height corresponding to the upper side of the electronic component. Further, in order to secure the recess on the further rear side from the position of the power source insertion port in the related art, the position of the back surface of the main apparatus body extends to the rear side as much as the recess takes up, and thus the entire length of the main apparatus body becomes long in the back and forth direction.

In the embodiment, as shown in FIG. 12, the power source substrate 101 is arranged in the main apparatus body 12 in a state in which a part of the power source substrate 101 is received in a projected section 12*g* which is projected on the lower side of the recess 12*c*.

In addition, the power source inlet 102 is arranged on the reverse surface side corresponding to the back surface 12*f* in a state in which the power source insertion port 28 is exposed in the back surface 12*f* of the recess 12*c*. That is, even when the power source substrate 101 is arranged such that the power source component 103 is received in the projected section 12*g*, the power source insertion port 28 is arranged in a position which can be exposed in the back surface 12*f* by arranging the power source inlet 102 in a position which is deviated to the front side from the back end of the power source substrate 101 and is deviated to the upper side.

In addition, although not shown in the drawing, the power source substrate 101 is covered by a power source casing, and a ventilation hole is formed in a part of the housing 12*a*. When ink leakage is generated in the main apparatus body 12, ink is prevented from attaching to the power source substrate 101 by the power source casing, and, further, when the ink leakage further proceeds, ink is discharged from the above-described ventilation hole to the outside of the main apparatus body 12. Therefore, it is possible to prevent ink from attaching to the power source substrate 101.

Figure 13:
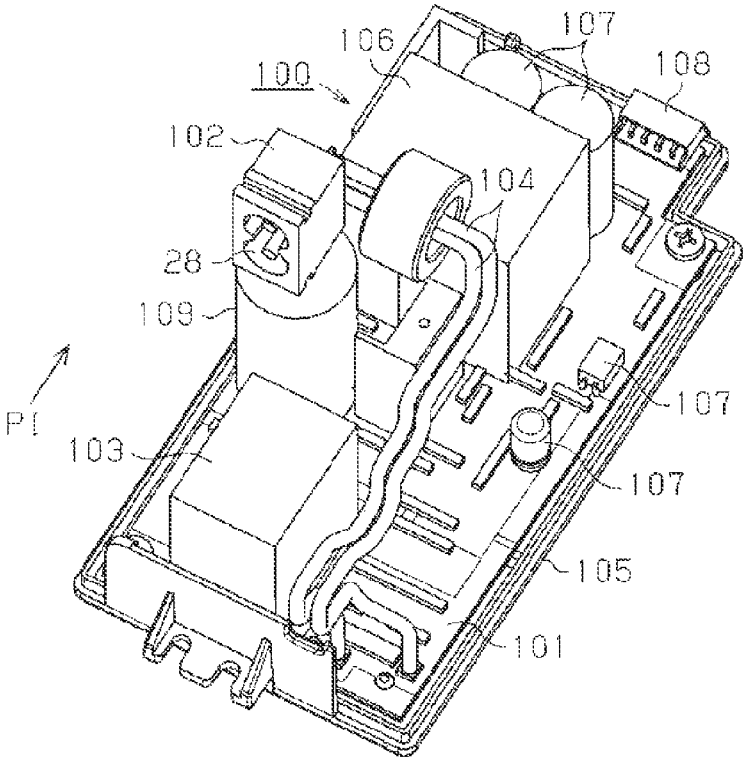
FIG. 13 is a perspective view illustrating the power source unit.

The power source substrate 101 which enables the above assembly includes a structure shown in FIG. 13.

As shown in FIG. 13, the power source component 103 is mounted on the rear end section (lower end section in FIG. 13) of the approximately square plate-shaped power source substrate 101, and another power source component 106 is mounted on the front end section. Further, the electronic components 107 having various sizes are mounted in a region other than the mounting area of the power source components 103 and 106 in the power source substrate 101. In addition, a connector 108, to which a power line is connected in order to output power, is mounted in the front end section of the power source substrate 101.

A cylindrical pillar 109 is arranged between the two power source components 103 and 106 in the back and forth direction, and the power source inlet 102 is fixed on the upper end surface of the pillar 109 in a state in which the power source inlet 102 faces the poser source insertion port 28 on the back surface side. The two wirings 104 include one end sections which are connected to a position in the vicinity of the power source component 103 on the power source substrate 101 and the other end sections connected to the power source inlet 102, and are extended through a predetermined wiring path.

Subsequently, an operation of the printer 11 which is configured as above will be described.

The printer 11 is connected to a host device for communication through a LAN cable by connecting the LAN cable to the communication port 25, or is connected to the host device for communication through the USB cable 26 by connecting the USB cable 26 to the communication port 27.

When the printer 11 receives print data from the host device, the paper P is first fed from the feed cassette 16 and is transported to a print start position. Subsequently, the printer 11 approximately alternately performs a single row of record operation on the paper P in such a way that ink drops are ejected from the recording head 20 when the carriage 18 is moving in the horizontal scan direction X, and a transport operation to transport the paper P to a subsequent record position, thereby printing an image on the paper P.

The main substrate 70 in the printer 11 is arranged in the direction in which the longitudinal direction thereof is identical to the transport direction Y, and arranged in a horizontal arrangement posture in which a component mounting surface faces upwards using a long-shaped free space which is present on the lower side of one end section in the width direction of the mechanical component arrangement area MA in the main apparatus body 12 and which is comparatively long in the transport direction Y. Since the main substrate 70 is arranged in the mechanical component arrangement area MA, it is possible to relatively shorten the entire length of the main apparatus body 12 in the width direction.

In addition, since the main substrate 70 is horizontally arranged in the free space on the lower side of the one end section in the width direction of the mechanical component arrangement area MA, a comparatively wide area, which is covered by the printer mechanism section PM and in which the wiring operation space is difficult to be secured, is present on the component mounting surface thereof (top surface). However, in the example, the plurality of relay substrates 91 and 92 are vertically arranged in the plurality of free spaces which are positioned on the upper side of the main substrate 70 in the mechanical component arrangement area MA while the component mounting surfaces thereof face the outside of the main apparatus body 12, and the plurality of connectors 98 and the single connector 99 are mounted on the mounting surfaces of the respective relay substrates 91 and 92. Further, the plurality of relay substrates 91 and 92 are connected to the main substrate 70 through the FFCs 96 and 97 by connecting the respective one end sections of the FFCs 96 and 97 to the connectors 77 and 77 on the main substrate 70 and connecting the other end sections of the FFCs 96 and 97 to the connectors 99 and 99 on the relay substrates 91 and 92.

Further, the wirings from some places of the printer mechanism section PM are respectively connected to the connectors 98 which are mounted on the plurality of relay substrates 91 and 92. In addition, the wirings from the other places of the printer mechanism section PM are respectively connected to the plurality of connectors 76 which are mounted on the area in which the wiring operation space can be secured in the component mounting surface of the main substrate 70. Therefore, even when the main substrate 70 and the plurality of relay substrates 91 and 92 are arranged in the mechanical component arrangement area MA, it is possible to simply perform the wiring operation to connect the wirings from some places of the printer mechanism section PM to the connectors 98 on the plurality of relay substrates 91 and 92, and the wiring operation to connect to the connectors 76 on the main substrate 70.

Further, the power source unit 100 is arranged to receive a part of the power source substrate 101 in the projected section 12*g* which forms the bottom surface of the recess 12*c* in the rear corner section of the main apparatus body 12, and the power source inlet 102 is arranged such that the power source insertion port 28 is exposed in the back surface 12*f* of the recess 12*c* in the power source plug insertion direction PI. The power source inlet 102 is fixed on the upper end surface of the pillar 109 which is arranged in a position deviated in the power source plug insertion direction PI from an end section of the power source substrate 101 on a side arranged in the projected section 12*g*, and is arranged on the back surface 12*f* at a height which enables the power source insertion port 28 to be exposed. Further, the power source inlet 102 is connected to a part of the power source substrate 101 through the wirings 104. Therefore, it is possible to arrange the back surface of the housing 12*a* in a comparatively front-side position as much as the arrangement position of the power source inlet 102 is deviated in the power source plug insertion direction PI from the end section of the power source substrate 101, and it is possible to relatively shorten the entire length of the main apparatus body 12 in the back and forth direction.

According to the embodiment described above, it is possible to obtain advantages shown below.

(1) Since the main substrate 70 is arranged in the mechanical component arrangement area MA, it is possible to reduce the width of the printer 11. At this time, a part of the component mounting surface of the main substrate 70 is covered with the printer mechanism section PM on the upper side thereof, and thus an area in which it is difficult to perform the wiring operation on the main substrate 70 is generated.

However, the relay substrates 91 and 92 which are electrically connected to the main substrate 70 are arranged in the mechanical component arrangement area MA, the wiring operation to connect the wirings extended from some places of the printer mechanism section PM to the connectors 98 mounted on the relay substrates 91 and 92 and the wiring operation to connect the wirings to the connectors 76 of the main substrate 70 may be performed, and thus it is possible to effectively perform the wiring operation.

(2) Since the relay substrates 91 and 92 are vertically arranged such that the component mounting surfaces thereof face the outside in the mechanical component arrangement area MA, it is easy to perform the wiring operation to connect the wirings from the printer mechanism section PM to the connectors 98.

(3) Since the plurality of relay substrates 91 and 92 are provided, it is possible to arrange the plurality of relay substrates 91 and 92 near to the main substrate 70 (for example, in the substrate arrangement area in a planar view) as much as possible using the plurality of comparatively small free spaces which are dispersed in the mechanical component arrangement area MA.

(4) Since the plurality of relay substrates 91 and 92 are arranged in the arrangement area of the main substrate 70 in a planar view, the length of the wirings of the FFCs 96 and 97 are comparatively shortened, and thus a wiring handling operation becomes simple.

(5) Since the plurality of relay substrates 91 and 92 are arranged on both sides, which interpose the carriage movement area CA of occupying a comparatively long area of the main apparatus body 12 in the width direction X, in the transport direction Y, it is easy to secure spaces for arranging the relay substrates 91 and 92 in the mechanical component arrangement area MA. For example, if the relay substrates 91 and 92 are arranged in places corresponding to the carriage movement area CA in the transport direction Y, there are problems in that the sizes of the relay substrates 91 and 92 are reduced and the number thereof is uselessly increased, or in that a large amount of change in the layout of functional components is forced to secure spaces for arranging the relay substrates 91 and 92. However, since the plurality of relay substrates 91 and 92 are arranged on both sides which interpose the carriage movement area CA, an appropriate number of relay substrates 91 and 92 is obtained without much reducing the sizes of the relay substrates 91 and 92, and a large amount of change in the layout of the functional components is not necessary to secure the space for arranging the relay substrates 91 and 92.

(6) The lateral plate section 54*a* which extends to the rear side from the foreside frame 54 which configures the main body frame 50 is provided to be arranged on the outside of the power transmission mechanism 59, which configures the medium transport section 34 in the mechanical component arrangement area MA, in the width direction. Further, the FFC 65, which includes one end section connected to the connector 76 (the second connector) on the main substrate 70, is wired on a surface opposite to the power transmission mechanism 59 with the lateral plate section 54*a* interposed therebetween, and the other end section thereof is connected to the substrate 93. Therefore, the FFC 65 which is connected between the main substrate 70 and the substrate 93 is wired on the surface opposite to the power transmission mechanism 59 with the lateral plate section 54*a* interposed therebetween. Therefore, even if, for example, the FFC 65 is deviated from a proper wiring path because the FFC 65 becomes loose, it is possible to avoid a state in which the deviated FFC 65 comes into contact with the power transmission mechanism 59.

(7) In the lateral plate section 54*a*, the notch recess 54*b* is formed in a section corresponding to the wiring path of the FFC 97 which is connected between the connector 77 of the main substrate 70 and the relay substrate 92. Therefore, it is possible to comparatively simply perform the wiring operation to connect to the connector 77 of the main substrate 70 to the relay substrate 92 using the FFC 97 through the notch recess 54*b* of the lateral plate section 54*a*.

(8) The base plate 71 of the main substrate 70 is divided into the first base plate 81 which supports a section including the mounting area of the power system electronic component 79 and which is formed of a material having a high thermal conductivity (as an example, aluminum-based metal), and the second base plate 82 which supports the other mounting area section and which is formed of a material having a lower thermal conductivity than that of the first base plate 81 (as an example, iron-based metal). Therefore, it is possible to effectively radiate heat from the power system electronic component 79.

(9) Since the extension section 83*b*, which extends from the heat-radiation cover 80 which covers the power system electronic component 79, and the extension section 81*a*, which extends from the first base plate 81, are fixed to the heat sink section 84 of the power system electronic component 79 by fastening the extension section 83*b* and the extension section 81*a* using the screw 85, it is possible to further effectively radiate heat from the power system electronic component 79.

(10) A part of the rear section of the power source substrate 101 which configures the power source unit 100 is received in the projected section 12*g* on the lower side of the recess 12*c*, and the power source inlet 102 is arranged on the reverse side (front side) of the back surface 12*f* with a height which enables the power source insertion port 28 be exposed on the back surface 12*f* in a state in which the power source inlet 102 is supported by the pillar 109 in the position deviated to the front side from the rear end of the power source substrate 101. Further, the wirings 104 which extend from the position in the vicinity of the power source component 103 in the rear end section of the power source substrate 101 is connected to the power source inlet 102. Therefore, since the configuration is provided in which it is not necessary to provide a space for recess to the rear side from the rear end of the power source substrate and in which a part of the power source substrate 101 is arranged on the lower side of the recess, it is possible to shorten the entire length of the printer 11 in the back and forth direction.

In addition, in a planar view seen from the height direction of the printer 11, the main substrate 70 is arranged in a position which is separated from the feed cassette 16. Therefore, since it is possible to reduce the height of the printer 11, the printer 11 can be thin.

In addition, the main substrate 70 is provided at the lower section of the power transmission mechanism 59 shown in FIG. 4. Therefore, since it is possible to shorten the length of the printer 11 in the width direction X and the transport direction Y, the printer 11 can be reduced.

In a planar view seen from the height direction of the printer 11, the main substrate 70 is arranged in the lower section which is separated from a region in which the liquid absorbers 120, 121, and 122 are arranged. Therefore, since it is possible to shorten the height of the printer 11, the printer 11 can be thin.

In addition, the printer 11 is formed of a single member, includes a base section which separates the feed cassette 16 and the medium transport section 34, and a main body frame which includes a section having an H-shape when viewed from the transport direction Y of the paper P transported by the medium transport section 34. Therefore, since the main body frame which includes an H-shaped section when viewed from the transport direction Y is formed of a single member, the size of the main body frame is suppressed from being large, and it is possible to acquire a high resistance to a twist with the width direction X of the paper P being used as a shaft direction or a bending along the transport direction.

Meanwhile, the embodiment can be modified to the following forms:

At least one relay substrate may be provided. For example, a single relay substrate may be provided. In addition, a plurality of relay substrates which are equal to or greater than three may be provided. When there are a plurality of relay substrates, the sizes thereof may be various. In addition, the connector 98 which is provided on the relay substrate may be one. Further, when there are a plurality of relay substrates, it is not essential that all the relay substrates are arranged in one of both end sections which interpose the transport region in the mechanical component arrangement area MA in the width direction X. For example, it may be configured such that at least one of the plurality of relay substrates is vertically arranged in an end section opposite to one end section in which the main substrate is arranged in the mechanical component arrangement area MA in the width direction while the component mounting surface thereof faces the outside of the main apparatus body in the width direction. In addition, at least one of the relay substrates may be arranged on the end section on the back surface or front surface sides of the mechanical component arrangement area MA in the mechanical component arrangement area MA. Further, the one end section in the width direction of the mechanical component arrangement area MA in which the main substrate 70 is arranged is not limited to the right-side end section in FIG. 6, and the one end section may be the left-side end section. In the latter case, it is preferable that the power source unit 100 be arranged in the right-side end section.

The plurality of relay substrates may be arranged on only the front side of the carriage movement area CA or only the rear side of the carriage movement area CA. In addition, in a configuration which includes a single relay substrate, the single relay substrate may be arranged on the front side of the carriage movement area CA or may be arranged on the rear side thereof.

Other substrates, each of which is the connection point of a wiring (FFC) wired on a surface (a surface on the outside of the width direction) opposite to the power transmission mechanism with the lateral plate section 54*a* interposed therebetween, are not limited to the wireless communication substrate 93, and may be the substrate 94 provided with a memory card connector. It is apparent that other substrates may be provided in addition to the relay substrates which are connected to the main substrate. It is apparent that the wirings (FFCs 96 and 97) which are connected to the relay substrate may be wired on a surface (a surface on the outside in the width direction) opposite to the power transmission mechanism with the lateral plate section 54*a* interposed therebetween.

The thermal conduction section is not limited to the extension section 81*a* which is integrally formed with the first base plate 81, and may be, for example, a separate member which is attached to the first base plate 81. For example, instead of the extension section 81*a*, a separate member of a metal plate is screwed to the first base plate, the metal plate is tightened together with the extension section of the heat-radiation cover using a screw, and may be fixed to the sink tank section of the power system electronic components in a state which thermal conduction can be performed.

Both the main substrate and the power source unit may be arranged in either section of both end sections of the mechanical component arrangement area in the width direction.

The main substrate may be arranged in either section area of a pair of end section areas on both sides which interpose the transport region of the mechanical component arrangement area in the width direction such that the longitudinal direction thereof crosses the longitudinal direction of the end section area.

The main substrate may be vertically arranged in the mechanical component arrangement area MA such that the mounting surface for the electronic components and the connectors (component mounting surface) faces outward in the width direction of the main apparatus body. In addition, a configuration in which the main substrate is arranged with being divided into a plurality of substrates, and the plurality of main substrates obtained through division are connected to each other using wirings may be adopted.

The support which supports the power source inlet is not limited to the pillar. For example, a bridge, which is installed on a substrate in a path which horizontally passes the upper side of at least a part of the power source component and the electronic components, may be the support.

The power source unit may be arranged in a position on the outside of the mechanical component arrangement area MA in the width direction.

The medium is not limited to paper and may be a film formed of resin, a metallic foil, a metallic film, a composite film (laminated film) formed of resin and metal, fabric, non-woven fabric, a ceramic sheet, or the like. Further, the medium is not limited to a sheet shape and may be a cubic object.

The printer (recording apparatus) is not limited to the ink jet type printer and may be a dot impact type printer or a laser printer. In addition, the printer is not limited to the serial printer and may be a line printer or a page printer. In conclusion, a recording apparatus which includes a mechanism section having a transport section which transports the medium (recording medium) and a recording section may be provided.

In the embodiment, the recording apparatus is embodied as the ink jet type printer which is one type of a liquid ejecting apparatus. However, when the recording apparatus is applied to a liquid ejecting apparatus, the recording apparatus is not limited to the printer. For example, it is possible to embody the recording apparatus as a liquid ejecting apparatus which ejects or discharges other liquid in addition to ink or a liquid type object in which functional material particles are dispersed in or mixed with liquid (which includes a flowing body such as gel). For example, a liquid ejecting apparatus may be provided which ejects a liquid type object in which materials are dispersed or dissolved, such as an electrode material, a color material (pixel material), or the like used to manufacture a liquid crystal display, an ElectroLuminescence (EL) display, and a surface emitting display. In addition, a liquid ejecting apparatus which ejects a bioorganic material used to manufacture a biochip or a liquid ejecting apparatus which ejects liquid functioning as a sample material used as a precise pipette may be provided. In addition, a textile printing apparatus, a micro-dispenser, or the like may be provided. Further, a liquid ejecting apparatus which ejects transparent resin liquid, such as a thermoset resin, on a substrate in order to form a minute hemispherical lens (optical lenses) or the like used for an optical communication device or the like, a liquid ejecting apparatus which ejects etching liquid, such as acid, alkali, in order to perform etching on a substrate, and a liquid ejecting apparatus which ejects a flowing body, such as gel (for example, physical gel) or the like, may be provided. Further, it is possible to apply a main substrate arrangement structure to any one kind of the liquid ejecting apparatuses. As described above, the medium may be a substrate on which an element, a wiring, or the like is formed through ink jet. The "liquid" ejected by the liquid ejecting apparatus includes liquid (which includes inorganic solvent, organic solvent, liquid solution, liquid resin, liquid metal (metallic melt), and the like), a liquid body, a flowing body, or the like.

The entire disclosure of Japanese Patent Application No.2012-152162, filed Jul. 6, 2012 is expressly incorporated by reference herein.

What is claimed is:

1. A recording apparatus comprising:

a mechanism section that includes a transport section which transports a medium, and a recording section which performs recording on the medium;

a substrate on which electronic components are mounted in order to control the mechanism section; and a medium reception section in which the medium supplied from a front side of the main apparatus body to the inside of a main apparatus body is set, wherein the substrate is arranged between a base of the main apparatus body and the mechanism section in a mechanical component arrangement area in which mechanical components included in the mechanism section are arranged in the main apparatus body, such that the substrate is positioned at a side of the mechanical component arrangement area where the mechanical components included in the mechanism section are not located, wherein the substrate is arranged in either section of both end sections which interpose a transport region of the medium in a width direction which crosses the transport direction in the mechanical component arrangement area, and wherein the substrate is arranged in a position which is separated from the medium reception section.

2. The recording apparatus according to claim 1, wherein the main apparatus body includes a power transmission mechanism which configures the transport section, and wherein the substrate is arranged at a bottom of the power transmission mechanism.

3. The recording apparatus according to claim 2 further comprising:

a main body frame that is arranged in the main apparatus body;

other substrates that are controlled by the substrate;

a second connector that is mounted on the substrate to be connected to a wiring between the substrate and the other substrates; and a lateral plate section that extends from the main body frame to be arranged on an outside of the power transmission mechanism in the width direction in the mechanical component arrangement area, wherein the wiring which includes one end section connected to the second connector is wired on a surface opposite to the power transmission mechanism of the lateral plate section, and configured to include the other end section connected to the other substrates.

4. The recording apparatus according to claim 1 further comprising:

a liquid ejecting head that ejects liquid toward the medium; and a liquid absorber that absorbs the liquid which is discharged to an outside of an end section of the recording medium from the liquid ejecting head, wherein the liquid absorber is provided between the medium reception section and the transport section, and wherein the substrate is arranged at a bottom separated from a region in which the liquid absorber is arranged.

5. The recording apparatus according to claim 1 further comprising:

a relay substrate that is connected to the substrate through wirings and includes connectors to be electrically connected to the mechanism section.

6. The recording apparatus according to claim 5, wherein a plurality of the relay substrates are provided.

7. The recording apparatus according to claim 6, wherein the plurality of relay substrates are arranged in one end section of the mechanical component arrangement area in which the substrate is arranged.

8. The recording apparatus according to claim 6, wherein the recording section includes a carriage provided to be able to move in a direction which crosses the transport direction of the medium, and wherein the plurality of relay substrates are provided on both sides which interpose a movement area of the carriage in the transport direction.

9. The recording apparatus according to claim 5, wherein the substrate is arranged in a free space on a lower side of the mechanism section while a mounting surface for the electronic components faces upwards, and wherein the relay substrates are vertically arranged such that a mounting surface for the connectors faces the outside of the main apparatus body in the width direction.

10. The recording apparatus according to claim 5 further comprising:

a main body frame that is arranged in the main apparatus body; and a lateral plate section that extends from the main body frame to be arranged on an outside of a power transmission mechanism in the width direction in the mechanical component arrangement area, wherein, in the lateral plate section, a notch recess is formed in a section corresponding to a path of the wiring connected between the connector of the substrate and the relay substrate.

11. The recording apparatus according to claim 1 further comprising:

a carriage having a head for ejecting ink, a guide rail for guiding the carriage, wherein the substrate is overlapped the part of the guide rail for width direction.

12. The recording apparatus according to claim 11, wherein the substrate is arranged the below of the guide rail.

13. The recording apparatus according to claim 1 further comprising:

a power transmission mechanism to transmit the power of the transport motor, wherein the substrate is arranged the below of the transport motor.

14. The recording apparatus according to claim 1 further comprising:

a communication connector is mounted on the substrate and arranged for the both front and rear side of the recording apparatus.

15. The recording apparatus according to claim 1 further comprising:

a power source unit includes a power source substrate, wherein the power source unit is arranged in opposite side of the substrate.

* * * * *